US011558950B2

(12) United States Patent
Fritz et al.

(10) Patent No.: US 11,558,950 B2
(45) Date of Patent: Jan. 17, 2023

(54) CONTROL DEVICE FOR AN X-RAY TUBE AND METHOD FOR OPERATING AN X-RAY TUBE

(71) Applicant: Cetteen GmbH, Förchheim (DE)

(72) Inventors: Stefan Fritz, Berlin (DE); Houman Jafari, Erlangen (DE); Jörg Rehrmann, Calden (DE)

(73) Assignee: Cetteen GmbH, Förchheim (DE)

( * ) Notice: Subject to any disclaimer, the term of this patent is extended or adjusted under 35 U.S.C. 154(b) by 0 days.

(21) Appl. No.: 16/643,526

(22) PCT Filed: Aug. 31, 2018

(86) PCT No.: PCT/EP2018/025225
§ 371 (c)(1),
(2) Date: Feb. 29, 2020

(87) PCT Pub. No.: WO2019/042587
PCT Pub. Date: Mar. 7, 2019

(65) Prior Publication Data

US 2020/0367350 A1 Nov. 19, 2020

(30) Foreign Application Priority Data

Sep. 2, 2017 (DE) ..... 102017008264.2

(51) Int. Cl.
*H05G 1/04* (2006.01)
*H05G 1/34* (2006.01)
(Continued)

(52) U.S. Cl.
CPC ..... *H05G 1/22* (2013.01); *H05G 1/04* (2013.01); *H05G 1/20* (2013.01); *H05G 1/34* (2013.01); *H05G 1/70* (2013.01)

(58) Field of Classification Search
CPC .. H05G 1/04; H05G 1/34; H05G 1/22; H05G 1/20; H05G 1/70
See application file for complete search history.

(56) References Cited

U.S. PATENT DOCUMENTS 3,783,288 A * 1/1974 Barbour ..... H05G 1/20 378/106
5,056,125 A 10/1991 Beland
(Continued)

FOREIGN PATENT DOCUMENTS

CA 2649320 10/2007
DE 102009017649 10/2010
(Continued)

OTHER PUBLICATIONS

Machine translation of DE 102010043540 A1 (Year: 2012).*
(Continued)

*Primary Examiner* — Chih-Cheng Kao
(74) *Attorney, Agent, or Firm* — Merchant & Gould P.C.

(57) ABSTRACT

The invention relates to a control device for an X-ray tube (2), comprising a housing (29) that is designed as a shield, in which an anode current regulating unit (1) is arranged and which is connected to a cathode power supply unit (18), a plurality of cathode voltage switches (20, 21, 22, 23, 24) which are to be connected to in each case a cathode (4), and a programmable assembly (25), in which the control of the cathodes (4) is determined. The cathode power supply unit (18), the cathode voltage switches (20, 21, 22, 23, 24) and the programmable assembly (18) are also arranged in the housing (29).

10 Claims, 13 Drawing Sheets

(51) Int. Cl.

| | |
|---|---|
| ***H05G 1/22*** | (2006.01) |
| ***H05G 1/70*** | (2006.01) |
| ***H05G 1/20*** | (2006.01) |

(56) References Cited

U.S. PATENT DOCUMENTS

| | | | | |
|---|---|---|---|---|
| 7,215,739 | B2 | 5/2007 | Cunningham et al. | |
| 7,751,528 | B2 | 7/2010 | Zhou et al. | |
| 2006/0018430 | A1* | 1/2006 | Cunningham | H05G 1/56 378/108 |
| 2008/0069420 | A1* | 3/2008 | Zhang | H01J 35/065 382/132 |
| 2009/0022264 | A1* | 1/2009 | Zhou | A61B 6/025 378/5 |
| 2010/0102241 | A1* | 4/2010 | Zeller | H04N 5/32 378/98 |
| 2010/0254507 | A1* | 10/2010 | Hampel | A61B 6/4028 378/7 |
| 2011/0002439 | A1 | 1/2011 | Zhang | |
| 2016/0206261 | A1* | 7/2016 | Lan | A61B 6/4405 |
| 2016/0372298 | A1 | 12/2016 | Evans et al. | |
| 2020/0187882 | A1* | 6/2020 | Mohammadi | A61B 6/032 |

FOREIGN PATENT DOCUMENTS

| | | | | |
|---|---|---|---|---|
| DE | 102009035547 | | 2/2011 | |
| DE | 102009035547 | A1 | 2/2011 | |
| DE | 102010043540 | | 3/2012 | |
| DE | 102010043540 | A1 * | 3/2012 | H01J 35/065 |
| DE | 102010043540 | A1 | 3/2012 | |
| DE | 102011076912 | | 6/2012 | |
| DE | 102010043561 | | 10/2012 | |
| DE | 102016013279 | | 5/2018 | |
| DE | 102016013533 | | 5/2018 | |
| EP | 1617764 | | 1/2006 | |
| EP | 1618368 | | 1/2006 | |
| GB | 2415589 | | 12/2005 | |
| GB | 2523796 | | 9/2015 | |
| JP | 406251733 | | 9/1994 | |
| WO | 2004096050 | | 11/2004 | |
| WO | 2004097386 | | 11/2004 | |
| WO | 2018/086737 | | 5/2018 | |
| WO | 2018/086744 | | 5/2018 | |

OTHER PUBLICATIONS

Japanese Patent Application No. 2020-533345, Notice of Reasons for Refusal (translation), dated Feb. 22, 2021.
EP Patent Application No. 18765807.5, Report, dated Apr. 9, 2020.
EP Patent Application No. 18765807.5, Response, Jan. 20, 2021.
Search Report mailed in PCT/EP2018/025225 dated Mar. 7, 2019.
International Preliminary Report mailed in PCT/EP2018/025225 dated Mar. 12, 2020.
Communication under Rule 161(1) and 162 in EP 18765807.5 dated Apr. 9, 2020.
Notice of Reasons for Refusal mailed in JP Application No. 2020-533345 dated Feb. 22, 2021 (with English translation).

* cited by examiner

CONTROL DEVICE FOR AN X-RAY TUBE AND METHOD FOR OPERATING AN X-RAY TUBE

The present application claims priority to German Patent Application No. 102017008264.2, filed on Sep. 2, 2017, and International Application No. PCT/EP2018/025225 filed on Aug. 31, 2018, titled "Control Device for an X-Ray Tube and Method for Operating an X-ray Tube," and assigned to the assignee of the present invention. German Patent Application No. 102017008264.2 and International Application No. PCT/EP2018/025225 are incorporated by reference herein.

BACKGROUND

The invention relates to a device for controlling an X-ray tube and a method for operating an X-ray tube.

A method for controlling an X-ray tube is known, for example, from U.S. Pat. No. 7,751,582 B2. In this case the X-ray system is designed as a tomosynthesis system having a plurality of stationary X-ray sources arranged in a row.

In general, X-ray tubes have electron emitters, the function of which can depend on various physical principles. In DE 10 2011 076 912 B4, among other things, dispenser cathodes are named as thermal emitters. Information on the use of dispenser cathodes, for example, can be found in DE 10 2010 043 561 A1.

Electronic control devices for multifocus X-ray tubes, the cathodes of which are intended for the thermal emission of electrons, are known, for example, from documents EP 1 617 764 B1 and EP 1 618 368 B1.

Particularly suitable emitters for field emission of electrons are emitters containing nanorods, especially carbon nanorods. In this connection reference is made to documents WO 2018/086737 A1 and WO 2018/086744 A2.

A method for regulation of the emission current for X-ray tubes is disclosed in DE 10 2009 017 649 B4. Here, a current regulation can be superimposed on a voltage regulation.

The investigation is based on the problem of further developing the control of X-ray tubes, especially X-ray tubes with field emission cathodes, compared to the prior art, wherein a particularly high operational reliability is to be achieved.

This problem is solved according to the invention by a device for controlling an X-ray tube according to claim 1. The problem is also solved by an operating method according to claim 13. In the following, embodiments and advantages of the invention explained in connection with the method will also apply to the controlling device and vice-versa.

The control device is intended for operating an X-ray tube comprising an anode designed as an X-ray emitter and a plurality of cathodes intended for generating electron beams directed toward the anode.

The control device includes a housing, designed as a shield, in which an anode current regulating device is arranged. The anode current regulating device is connected to a cathode power supply unit, with a plurality of cathode voltage switches each to be connected to a cathode, as well as with a programmable assembly in which the control of the cathodes is determined. In this case also the cathode power supply unit, the cathode voltage switch, as well as the programmable assembly are arranged in the housing noted.

As a result of the shielded placement of the power and control electronics for the electron tube in the common housing, together with a suitable circuit board layout, the electromagnetic radiation emittance is distinctly reduced compared with conventional solutions. Thus effects on and interference with other electronic equipment as well as between different circuit sections of the electronic system can be prevented.

For example, the programmable assembly of the control device comprises an FPGA (Field Programmable Gate Arrangement) and at least one digital-analog converter. The anode current control unit, which is a central voltage-controlled current source, is controlled by the FPGA or another programmable assembly or an arrangement of such assemblies over the at least one digital-analog converter. The FPGA or an element with comparable function controls a number of subsystems. Possible subsystems in the present case may include the voltage supply unit—i.e., the power supply unit—of the cathodes, an anode power supply unit, various supply units for focusing devices and grids, as well as a power source to be assigned to the anode current control unit and the cathode voltage switches.

Even before the performance of a pulse sequence of the cathodes, the FPGA is already programmed such that the pulse sequence is triggered in real time. The timing of the pulse sequence takes place purely through the FPGA or an element of similar function. To allow for rapid switching between various current values, for example two analog-digital converters are each programmed with the voltage value corresponding to the equivalent current. Through a multiplexer it is possible to switch between the desired voltage level for a boost or for the actual pulse. The boost is defined here as a peak generated at the beginning of the pulse, with which a rectangular form of the pulse with improved approximation to the theoretical ideal form can be achieved compared with pulses generated without a short-term voltage overshoot.

The cathode voltage switch over which the cathodes, i.e., the electron emitters of the X-ray tube, are supplied with electric power, are structured for example as a high-voltage switch bank with a number of MOSFETs. Here, several MOSFETs are connected in series, optionally within a single cathode voltage switch.

The anode current control unit makes it possible to control the electron current emitted by the cathodes, i.e., electron emitters, from cathode to cathode in real time. In each case, an actual current flowing through the cathode and an assigned nominal-value current enter into the control. In addition, currents flowing through extraction grids and through focusing devices can enter into the control.

Since the order in which the high-voltage switches can be controlled is freely programmable, the sequence and number of emitters used can be freely programmed. Thus not all emitters must be operated, and the X-ray tube can also be operated as a single-beam tube. When a corresponding multiplexer is used, several or all channels may be activated simultaneously and thus electron emitters activated in parallel.

Typically, focusing electrodes are assigned to the individual cathodes. In a preferred embodiment, an extraction grid located between the cathodes and the focusing electrode is grounded independently of the focusing electrodes.

Through the energy supply of the focusing electrodes and grid, the thermal focal spot size on the anode can be adjusted individually from emitter to emitter. The thermal focal spot size is to be considered without projection in this situation. The X-ray focal spot size to be viewed under a projection is to be distinguished from this. It is also true for the X-ray focal spot size that this can be adjustable from pulse to pulse for each emitter. As long as the focusing electrodes can be operated at constant voltage, the focal spot size can be adjusted by varying the grid voltage, also in the form of fine tuning. This is true both in the continuous mode and for a pulsed mode, wherein in each case adjustments different from emitter to emitter are possible in all cases.

Fundamental considerations on controlling the cathodes and advantages achieved are summarized as follows:

Through the bank of high-voltage switches, each of which is assigned to a respective cathode, it is possible to switch rapidly between the individual channels. Each switching channel of the bank in this case preferably comprises several serial SiC MOSFETs to achieve the necessary cutoff voltage. In the case of a flashover that is detected by the FPGA via the gate emitter voltage after the power source or by the anode control via the altered anode current, for protecting the emitter, the total gate drive circuit is separated from the MOSFETs, which form the bank from high-voltage switches. This is realized via the multiplexers with which the output of the joint gate driver is distributed to the individual channels of the bank of high-voltage switches in normal operation. To protect the bank of high-voltage switches from destruction in case of a flashover, the voltage is preferably monitored by a circuit via the MOSFET cascade.

According to an advantageous further development, the programmable assembly of the control device is designed for storing the operating parameters, especially including current and voltage values, measured during operation of the X-ray tube.

Monitoring the control device is especially significant with regard to flashovers, which may conceivably occur during operation of the X-ray tube because of the high voltages at the anode. A flashover is a short circuit between electron emitters and anodes. In this process, the anode current may reach a current peak, which lasts only nanoseconds. Because of the rapidity of the anode current control, in the microsecond range, this current pulse will very likely not be detected by the control. However, the current pulse can be demonstrated in the measured anode current.

Therefore, in advantageous process control to protect against flashover, the measured anode current is compared with an adjustable maximum value of the anode current in a comparator. In case of a flashover and thus exceedance of the maximum current value, a positive voltage is achieved at the outlet of the comparator, representing a digital value of one. When the value is below the maximum, the comparator puts out the base value, in other words, digital zero. The duration of this detection mechanism depends almost exclusively on the duration of detection of the comparator. Depending on the comparator, this is in the pico- or nanosecond range. As soon as the maximum value is exceeded, the digital value of the comparator is transmitted with the aid of an optocoupler over an additional connecting cable between the anode power supply unit and the voltage supply unit of the cathodes, and the electron emission of the cathode is stopped immediately by a MOSFET switch so that no damage to the electron emitter will occur. Furthermore, in a certain form of flashover, conclusions can be drawn regarding a flashover that will occur in the future, based on the change in the anode current trend and the cathode current trend. For this purpose the anode current is measured, as described, and when the anode current and the cathode current decline without a reason being apparent from the control (the anode current target value not having been changed), the predicted occurrence of a flashover will be transmitted based on the same transmission mechanism as described above to the voltage supply unit of the cathodes. Then the electron emission of the cathode will be turned off even before flashover takes place. In this form of flashover avoidance, the time to shut-off of the electron emission is less critical, since as measurements have shown, the decrease in the anode current can already be detected microseconds before the flashover occurs.

If a flashover should nevertheless occur, the influence thereof is minimized in an advantageous configuration in that the electrical voltages of the power supply unit of the cathode are based on the grid. Thus the voltage difference between the grid and the emitter will not be changed in the case of a flashover onto the grid and thus also the number of electrons released in the emitter will not be changed. This ensures a long useful life of the emitter. The voltage between anode and grid altered by flashover to the grid does not present a threat to the lifetime of the emitter.

In the X-ray tubes operated using the control device, for example, dispenser cathodes are used as electron emitters.

In particularly preferred embodiments, the cathodes of the X-ray tube are field emission cathodes, especially cathodes with nanorods, also called nanosticks.

The nanosticks are preferably made of a material that has the lowest possible electron work function relative to the quantum mechanical field emission effect. Here, the nanosticks have a composition that is inherently uniform or nonuniform and are formed either as hollow bodies, i.e., tubes, or in solid form. The cathodes may be nanosticks of the same kind or a mixture of different kinds of nanosticks, wherein the kind of the nanosticks relates to their material composition and material modification.

Suitable materials in pure or doped form for the field emission of electrons are, for example, single- or multiple-walled carbon nanotubes, single- or multiple-walled hetero-nitrogen-carbon nanotubes, rare earth borides, especially lanthanum hexaboride and cerium hexaboride, metal oxides, especially $TiO_2$, MnO, ZnO and $Al_2O_3$, metal sulfides, especially molybdenum sulfide, nitrides, especially boron nitride, aluminum nitride, carbon nitride, gallium nitride, carbides, especially silicon carbide, silicon. Starting products for producing the nanosticks, which emit electrons during operation of the cathodes, also include rod-shaped, optionally hollow, elements made of polymeric materials. The nanosticks of the cathodes are optionally made from starting products that are only partially made of polymer materials, especially in the form of a coating.

In a particularly preferred embodiment, on their surfaces the cathodes have nanosticks in a preferably vertical direction, in other words, in the direction of the anode. Upon operation of the X-ray emitter and at adequate distances from one another, very strong electric fields can be generated at the tips of the nanosticks, substantially simplifying the emission of electrons.

In pulsed operation of the cathodes, capacitances of the cathodes and the elements electrically connected to the cathodes, especially supply lines, play a role. To minimize undesirable effects of such capacitances, optionally a discharge circuit is connected to the cathode voltage switch. The discharge circuit represents a complementary solution component to the previously described voltage overshoots, at the beginning of a rectangular peak to be generated.

In addition to the pulsed operation of the cathodes, in a preferred embodiment, pulse operation of the anode of the X-ray tube is also possible. Here, an anode voltage supply unit supplies a direct current in the form of a pulsed unipolar voltage. In this embodiment the anode voltage supply unit to be assigned to the control device is preferably a Marx generator. The level of the voltage pulse applied to the anode can differ from pulse to pulse.

The method of the invention for operating the X-ray tube is characterized by the following features:

A target value of the electric current flowing through the anode is specified

The current actually flowing through the anode is regulated via a single current source, which is connected to several switches, each of which is assigned to one cathode.

The anode current regulation can take place in various ways, explained in the following. First, the commonalities of all control possibilities will be discussed, and finally the differences in them will be pointed out.

Upon emission of electrons in the X-ray tube, an anode current flows through both a cascade assigned to one of the control devices and connected to the X-ray tube and also through a control unit forming a component of the control device. This is converted into a voltage and measured either in the control unit or in the cascade by a measuring resistance or an operating amplifier circuit.

This voltage, proportional to the anode current, serves as the input variable for anode current regulation. Here, the voltage values can be present, either in digital form through an analog-digital converter or as an analog value. An additional input value is the information about the current setpoint. Here also the information may consist of a digital value or an analog voltage value obtained from a voltage value proportional to the current setpoint, wherein an analog value is obtained with the aid of a digital-analog conversion.

In any case, the current setpoint of the cathode is obtained as the initial value. This means that an internal control loop for regulating the cathode current is present, so that this will follow the cathode current setpoint as rapidly as possible. Furthermore there is an external control loop that regulates the anode current by changing the cathode current setpoint. For anode current regulation through specification of the cathode current setpoint, the anode current information must be transmitted, by either digital or analog means, from the circuit board that accomplishes power supply for the anode to the circuit board over which the cathode is supplied with electric power. In the case of analog transmission, the circuit boards are connected with a cable that is as interference-free as possible. For this purpose the reference potential of the anode voltage, proportional to the anode current or the digital value must be altered because of the different voltage ranges on the individual circuit boards. This is done by using analog or digital optocouplers.

Basically two possibilities exist for accomplishing the control. The control can either be established digitally in the form of an algorithm or in an analog manner as an operational amplifier. There is an advantage to digital control in that it is easily adaptable. However, the control is not as rapid as with the analog variants. On the other hand, it was found by measurements that the anode current is constant over a long time period and differs from the cathode current only by a constant transmission factor. Therefore, even without active control, the anode current can be adapted to the anode current by determining the transmission factor in an initial calibration run and storing the transmission factor in a lookup table of the anode current. These two control methods may also be combined, so that first the transmission factor is determined and the anode current is set using this, and then the anode current is kept constant even if the transmission rate changes using analog or digital control.

During operation of the X-ray tube, as a result of already mentioned focusing mechanisms, each of which is assigned to a cathode, focal spots can be produced on the anode, differing from one cathode to another. Variation of the focal spot size is possible both at constant anode voltage and in the case of pulsed anode voltage with voltage different from pulse to pulse. The possibility also exists of influencing the geometry of a focal spot with an extraction grid located before the electron-emitting material, i.e., using the extraction grid as a means for focusing the electron beam.

According to an advantageous process variant, changes in the current flowing through the anode are detected so that a trend of the changes can be determined if necessary. By automatically determining and evaluating a trend of this type, under certain circumstances an increasing risk of flashover between anode and electron emitter can be inferred. In such a case the power supply of the cathode will be cut off automatically to prevent damage to the X-ray tube and minimize downtime.

If the anodes are operated in pulsed fashion, capacitances of the anode and connected components are also significant. As a rule, a rectangular pulse form is desired during pulsed operation of the anode. To achieve the rectangular form as well as possible, a voltage overshoot can be generated at the beginning of a pulse to compensate for the effect of unwanted capacitances. A particular advantage of pulsed operation of the anode is the fact that successive pulses may be at different voltage levels. As a result of the different voltage levels, X-ray pulses with different wavelengths of X-ray radiation are generated. The wavelengths in these cases can be adapted to the X-ray properties of different materials found in the object to be examined. This allows various materials in the object to be examined to be distinguished very well. This is preferably done with a stationary, especially non-rotating, arrangement of X-ray sources.

LIST OF SYMBOLS

Figure 1:
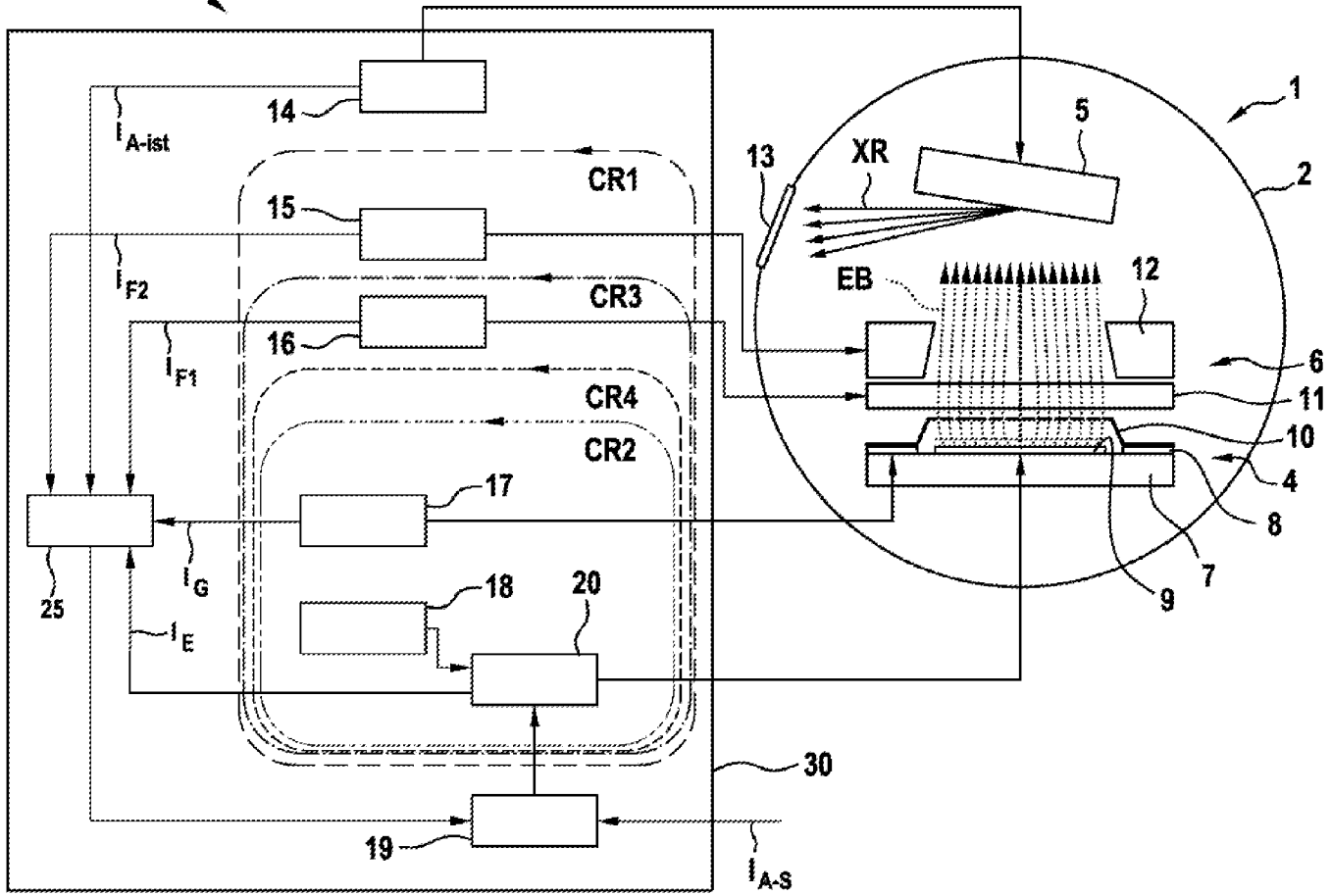
FIG. 1 is a an overview of an X-ray apparatus.
Figure 2:
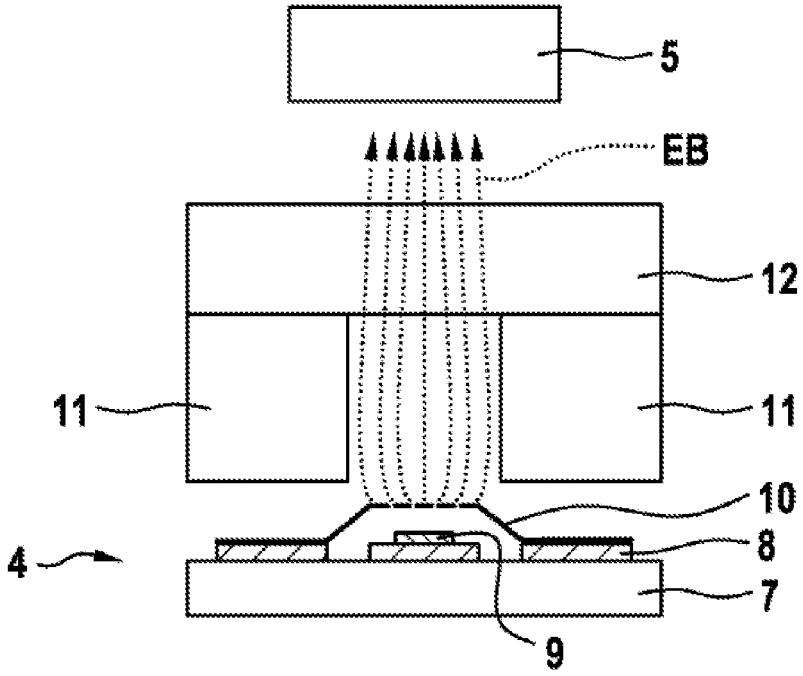
FIGS. 2-3 provide a focusing device suitable for the X-ray apparatus according to FIG. 1.
Figure 3:
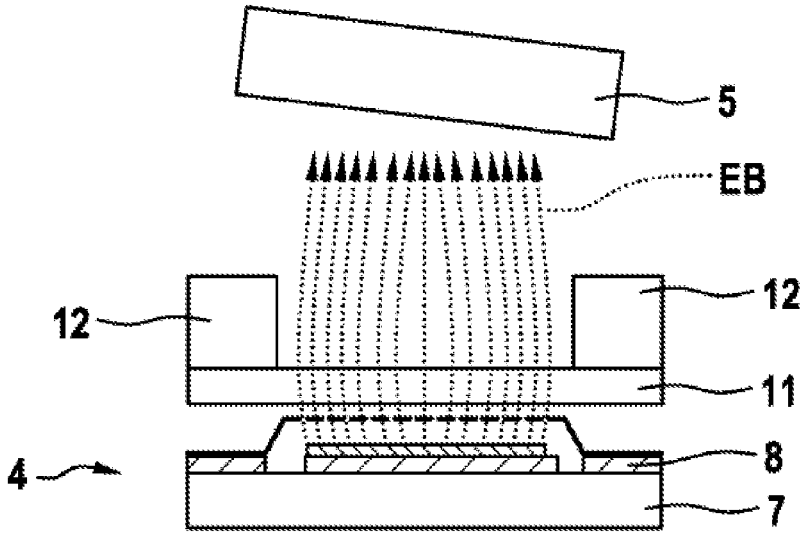
Figure 4:
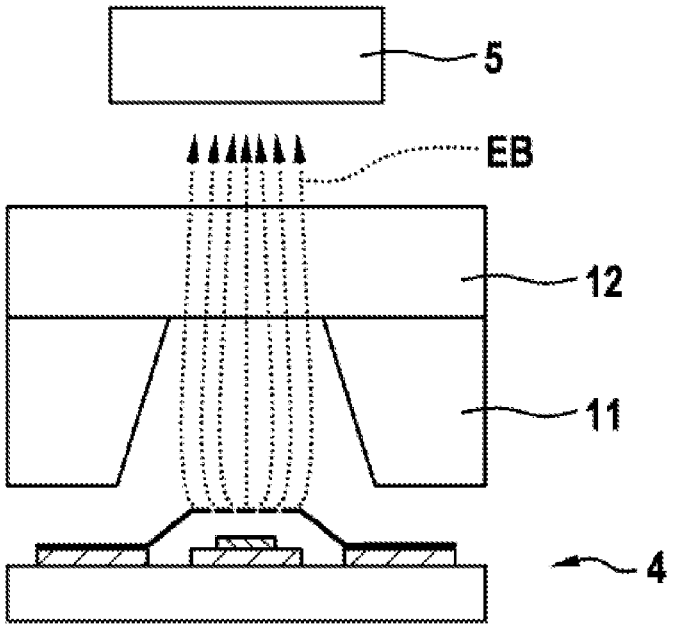
FIGS. 4-5 show the focusing device incorporated in the X-ray apparatus according to FIG. 1.
Figure 5:
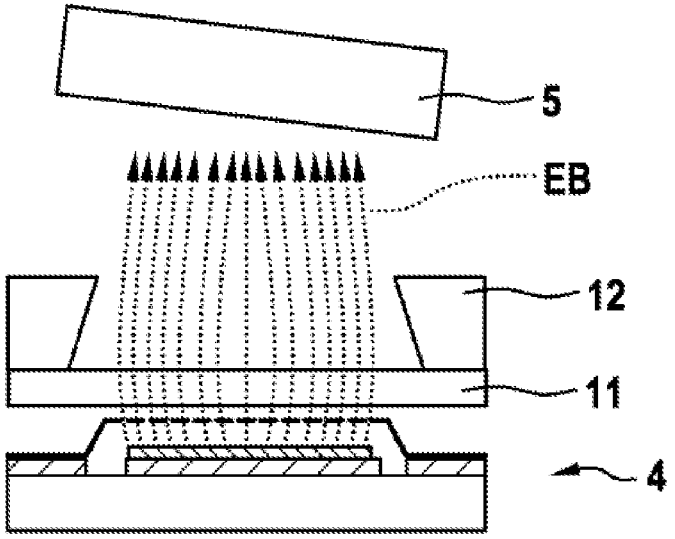
Figure 6:
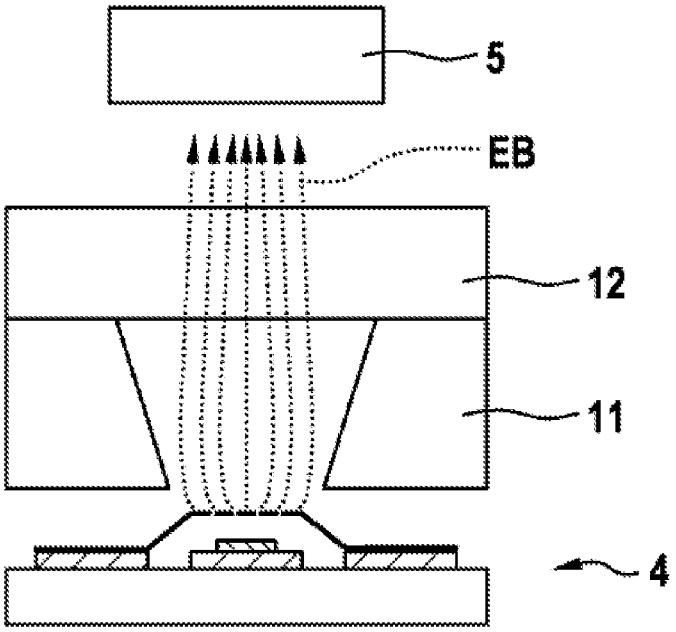
FIG. 6-7 depict an additional possible embodiment of a focusing device suitable for the X-ray tube according to FIG. 1.
Figure 7:
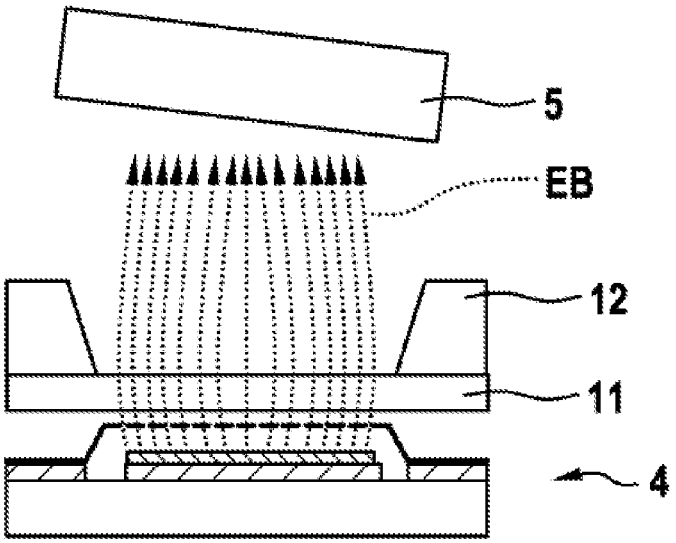

1. X-ray apparatus
2. X-ray tube
3. Control device
4. Electron source, cathode
5. Anode
6. Focusing device
7. Ceramic substrate
8. Metallization
9. Emitter layer
10. Extraction grid
11. Focusing electrode
12. Focusing electrode
13. X-ray window
14. Anode power supply unit
15. Voltage supply unit of the focusing electrode 12
16. Voltage supply unit of the focusing electrode 11
17. Voltage supply unit of the extraction grid
18. Voltage supply unit of the cathodes
19. Anode current control unit
20. Cathode voltage switch
21. Cathode voltage switch
22. Cathode voltage switch
23. Cathode voltage switch
24. Cathode voltage switch
25. Programmable module
26. Microcontroller
27. FPGA
28. Cathode control device
29. Housing
30. Exterior housing
31. Anode controller
32. Step-down converter
33. Royer oscillator
34. Transformer
35. Cascade circuit
36. User interface
37. Digital signal processor
38. FPGA
39. Optocoupler
40. FPGA
41. Digital-analog converter
42. Switching element
43. Multiplexer
44. Connection
45. Connection
46. Voltage monitoring
47. Gate driver
48. Logic building block
49. Optocoupler
50. Inverter
51. Trigger signal
52. Gyrator circuit
53. Phase shift PWM controller
54. Oil tank
55. Controller
56. Alternating current-direct current converter
57. Gate driver
58. Gate driver
59. Optocoupler
60. High-voltage switch
61. Line voltage connection
62. Inverter
63. Transformer
64. Alternating current-direct current converter
65. Marx generator
66. Circuit
67. Measuring device
68. Discharge circuit
BP Reference potential
CoV Compensator voltage
CR1 . . . CR4 Control loop
EB Electron beam
EP Discharge phase
GA1, GA2 Grid connections
HA Heating connection
$I_{A\text{-}actual}$ Anode actual current
$I_{A\text{-}S}$ Anode current setpoint
IC Inductor current
$I_E$ Emitter current
IER Inductor energy recovery phase
$I_{F1}$ Current through focusing electrode 11
$I_{F2}$ Current through focusing electrode 12
$I_G$ Grid current
IP Idling phase
KS Constant current level
PE Peak
PPC Prepulse compensation
PrPh Preload phase
PuPh Pulse phase duration
RS Ramp start
RE Ramp end
RV Ramp shift
Sig Output signal
SR Voltage decline phase
t, $t_0$, $t_1$ Time
T1, T2, T3 Trigger signals
$U_A$ Anode voltage
$U_{F1}$, $U_{F2}$ Voltage of focusing electrodes 11, 12
$U_G$ Grid voltage
VI Comparison current
VSi Comparison signal
XR X-ray radiation

DETAILED DESCRIPTION

Unless stated otherwise, the explanations that follow pertain to all exemplary embodiments. Corresponding parts or parameters are labeled with the same reference symbols in all Figures.

An X-ray apparatus 1 comprises an X-ray tube 2 and a control device 3. Components of the X-ray tube 2 are a cathode 4 as electron source and an anode 5, which is struck by an electron beam EB generated by the cathode 4, generating X-rays XR. Between the electron source 4 and the anode 5, a focusing device 6 for the electron beam EB is located.

In the exemplary embodiment according to FIG. 1, the electron source 4 is designed as a field emission cathode. Here, on a ceramic substrate 7, a metallization 8 and an emitter layer 9 containing carbon nanotubes are located. An extraction grid 10 is at a slight distance from the emitter layer 9.

The focusing device 6 comprises various focusing electrodes 11, 12 connected sequentially. Design variants of the focusing electrodes 11, 12 are sketched in FIGS. 2 to 7. In each case, the X-rays XR generated at a focal spot of the cathode 5 pass through an X-ray window 13 from the X-ray tube 2. A corresponding detector for the X-ray apparatus is not shown.

The control device 3 used for operating the x-ray tube 2 comprises an anode power supply unit 14, which supplies the anode 5 with high voltage. The electric current actually flowing through the anode 5 is designated as $I_{A\text{-}actual}$. In contrast, $I_{A\text{-}S}$ designates the anode setpoint.

The value of the anode setpoint, $I_{A\text{-}S}$ is entered into an anode current control unit 19. The anode current control unit 19, as the power source, constitutes a central unit of a current control loop, which can be of various types, as will be further explained in the following.

Figure 8:
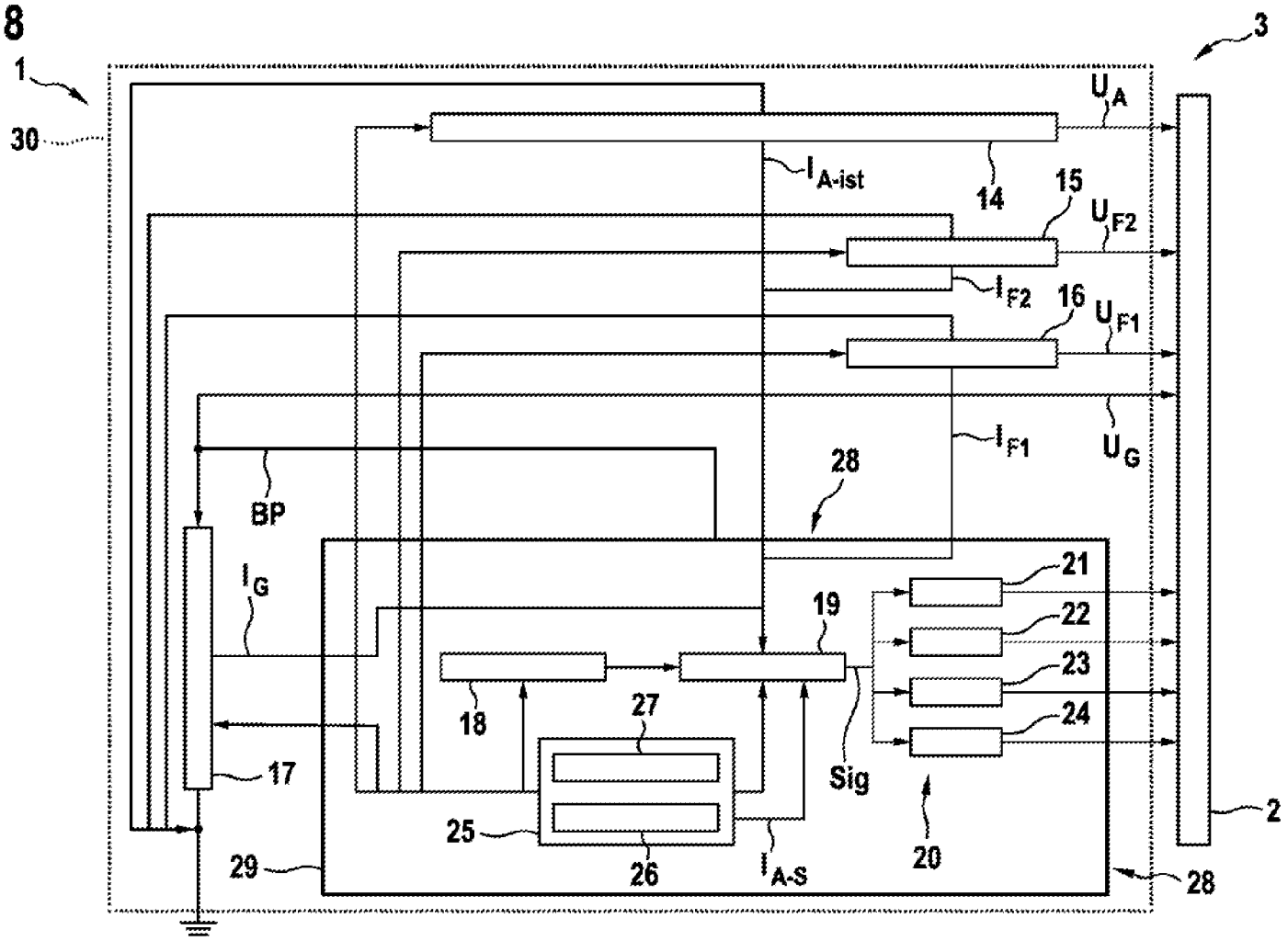
FIG. 8 is a schematic representation of a control device for the X-ray apparatus according to FIG. 1.

Independently of the detailed design of the anode current control, the control device 3 includes a voltage supply unit 15 of the focusing electrode 12 and a voltage supply unit 16 of the focusing electrode 11. In addition, a voltage supply unit 17 of the extraction grid 10 is present. The voltage supply unit 17 comprises an insulating transformer. With this, galvanic separation between the reference potential designated as BP in FIG. 8 and the ground, also shown in FIG. 8, is present. This separation is of decisive significance for avoiding damage to the X-ray tube 2 in case of a flashover from the anode 5. If charged particles are emitted by the anode 5, these are deflected by the focusing electrodes 11, 12, so that the potential of the focusing electrodes 11, 12 is briefly elevated. If a galvanic connection were to exist between the focusing electrodes 11, 12 on one hand and the extraction grid 10 on the other hand, the potential of the extraction grid 10 would also be increased as a result. This in turn would result in increased emission of the electron source 4, which would result in an avalanche-like increase in the release of particles form the anode 5. An effect of this type, which could have negative consequences extending to destruction of the cathode 4, is avoided by separating the reference potential BP on which the extraction grid 10 lies, from the focusing electrodes 11, 21. The potential of the focusing electrodes 11, 12 is designated by $U_{F1}$, $U_{F2}$ and falls in the range between minus 10 kV and plus 10 kV. $U_g$ designates the potential of the extraction grid 10, which falls in the range between minus 5 kV and plus 5 kV.

The anode current control unit 19 is connected with a voltage supply unit 18 of the cathodes 4 and a cathode switch arrangement 20. In addition, the anode current control unit 19 is connected with a programmable assembly 25, which comprises a microcontroller 26 and a FPGA (Field Programmable Gate Arrangement) 27. The components 18, 19, 20, 25 mentioned are assembled into a cathode control device 28, which is located in a housing 29 designed as a shield. An external housing 30 shown in broken lines in FIG. 8 also surrounds the other components of the control device 3.

Figure 9:
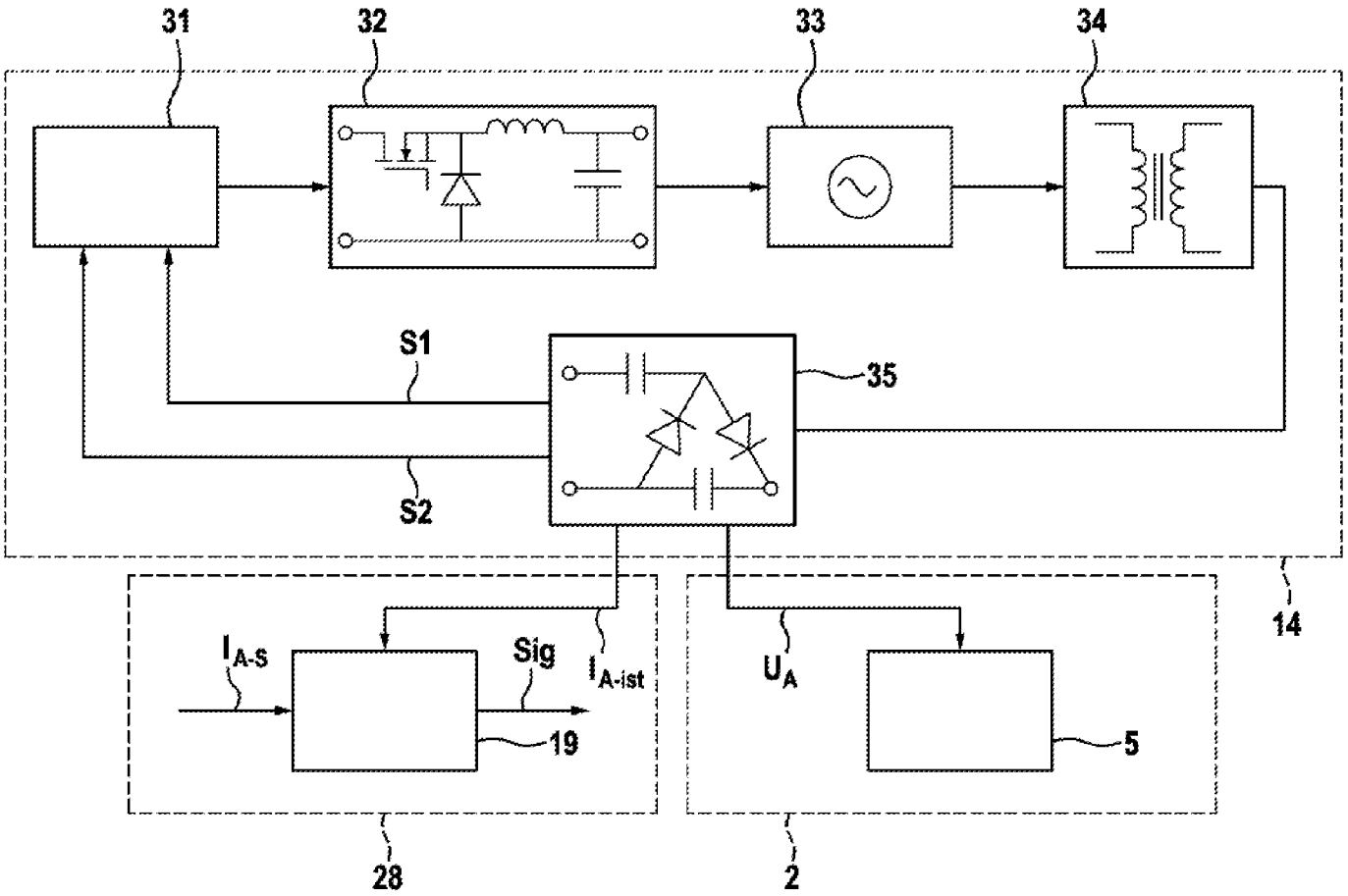
FIG. 9 shows the theoretical design of an anode power supply unit of the x-ray apparatus according to FIG. 1.

These additional components include, among other things, the anode power supply unit 14. As is apparent from FIG. 9, the anode power supply unit 14, comprises an anode controller 31, a step-down converter 32, a Royer oscillator 33, a transformer 34 and a cascade circuit 35. The cascade circuit 35 supplies an outlet voltage $U_A$, which is applied to the anode 5. The signal delivered by the anode current control unit 19, which is conducted to the cathode switch arrangement 20, is generally designated by Sig.

Figure 10:
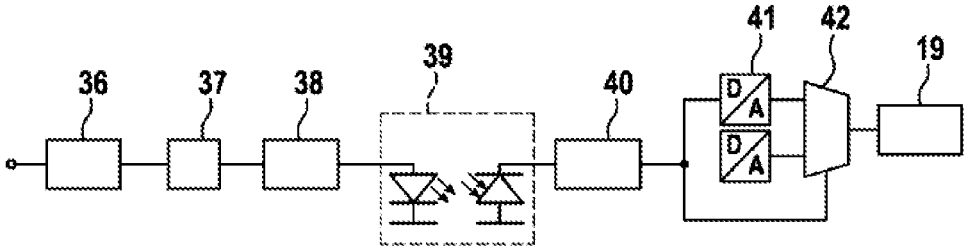
FIG. 10 shows a signal chain for controlling a current source for supplying power to the cathodes of the X-ray apparatus according to FIG. 1.

The control of the emitter current source, i.e., the anode current control unit 19, is visualized in FIG. 10. Here, 36 designates a user interface, 37 a digital signal processor, 38 an FPGA, 39 an optocoupler, 40 another FPGA, 41 a digital-analog converter and 42 a switching element, which connects the two digital-analog converts 41 with the anode current control unit 19.

Figure 11:
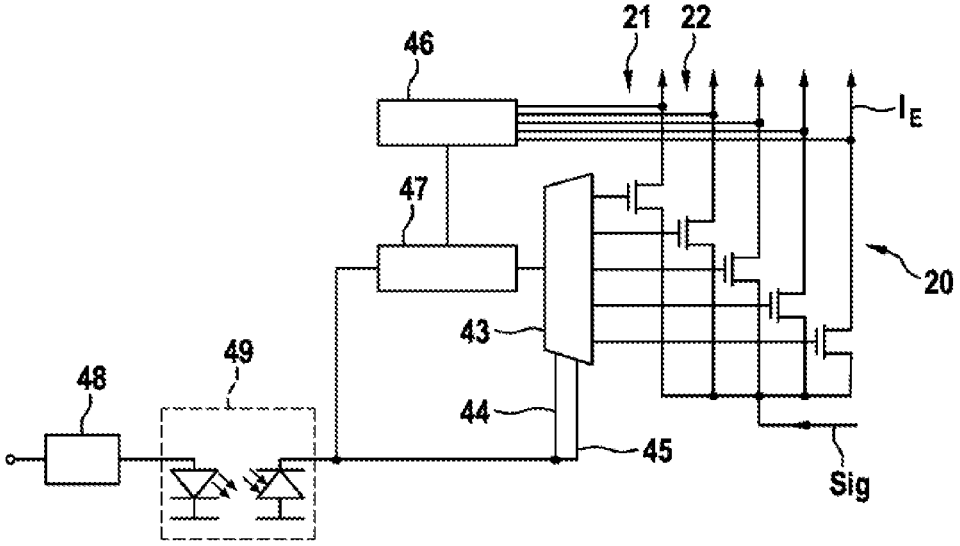
FIG. 11 provides a block diagram, the structure of a high-voltage switch bank, which is supplied with power via the power source in FIG. 10.

The signal Sig delivered by the anode current control unit 19 is conducted to the cathode switch arrangement 20, as is sketched in FIG. 11. The cathode switch arrangement 20 comprises individual cathode voltage switches 21, 22, 23, 24, the number of which corresponds to the number of cathodes 4 to be controlled. The emitter current is designated by $I_E$. The voltage applied to the individual emitters, i.e., cathodes 4, is monitored with the aid of the voltage monitor 46. The voltage monitor 46 is connected to a gate driver 47, which interacts with the cathode voltage switches 21, 22, 23, 24 via a multiplexer 43. Additional connections of the multiplexer 43 are designated with 44, 45. The gate driver 47 is connected over an optocoupler 49 with a logic module 48, which is at a low voltage level.

Figure 18:
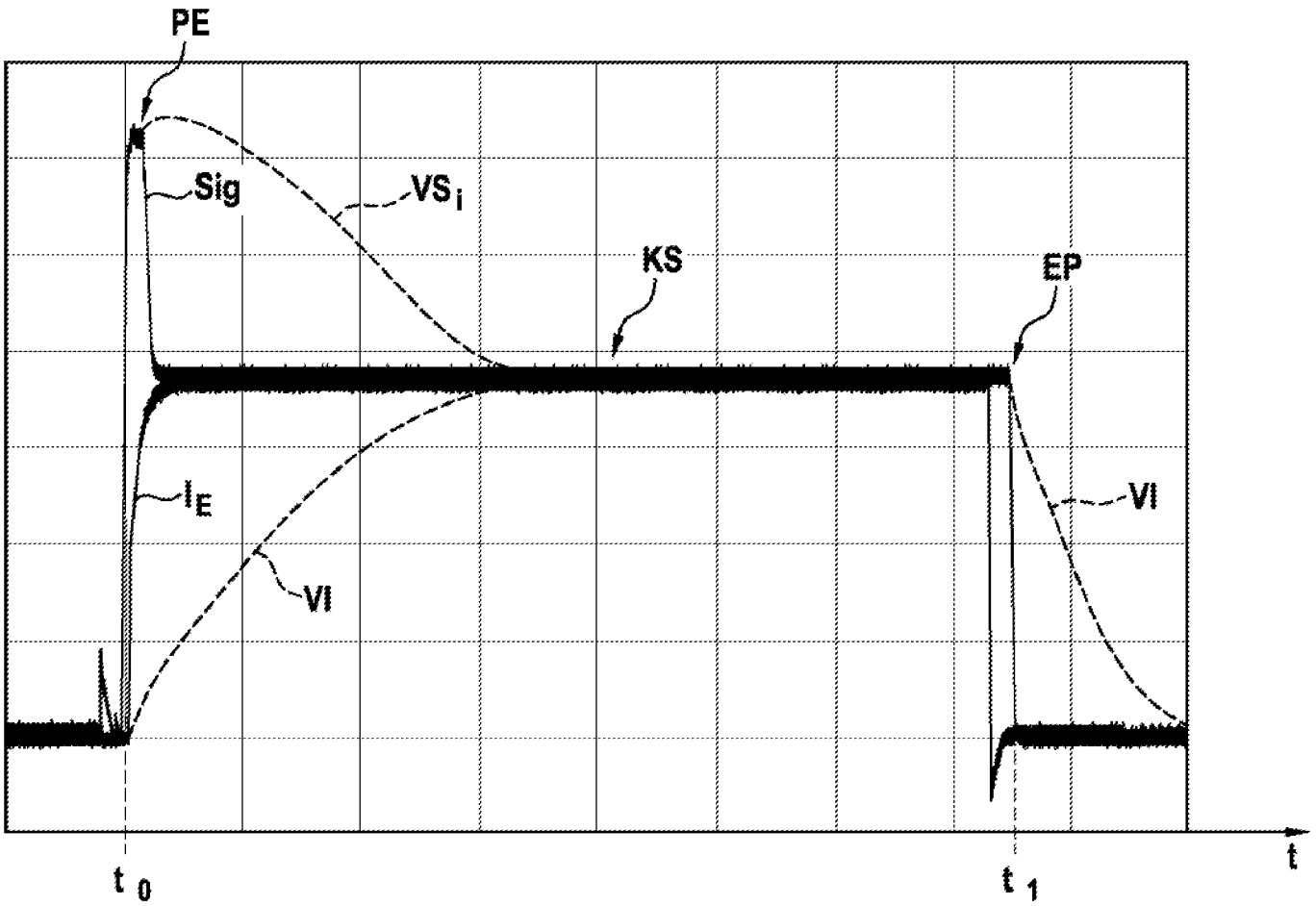
FIG. 18 is a diagram of a current pulse generated with the cathode control device of the x-ray apparatus according to FIG. 1.

With the aid of the circuit according to FIG. 11, current pulses are generated, more information about which is shown in FIG. 18. The current pulse is a rectangular pulse extending from time $t_0$ to time $t_1$. To approach the desired rectangular form with the emitter current $I_E$ as closely as possible, at the beginning of the pulse, the signal Sig describes a peak PE, with which parasitic capacitances are balanced out. In this way a constant current level KS is achieved practically over the entire pulse.

As is apparent from FIG. 18, the PE peak is very narrow compared to the total pulse. In particular, a rapid decrease in the PE peak takes place. The PE peak is achieved with the aid of a so-called current boost. In addition, for comparison with a non-claimed solution, a comparison signal VSi is also drawn in in FIG. 18. The comparison signal VSi generated without current boost, which in contrast to the PE peak exhibits a slow decline toward the maximum, which coincides with the maximum of the PE peak, means that the current pulse, shown in FIG. 18 as the comparison current VI, rises substantially more slowly and also falls more slowly, so that overall a rectangular shape of the current pulse is not achieved. In the case of current pulses following one another in rapid succession this also has the unwanted effect that pulses can overlap.

The control device 3 offers the possibility of operating not only the cathodes 4 but also the anode 5 in pulsed mode. As is apparent from FIG. 12, the anode power supply unit 14 comprises an inverter 50 and a gyrator circuit 52, among others.

Figure 12:
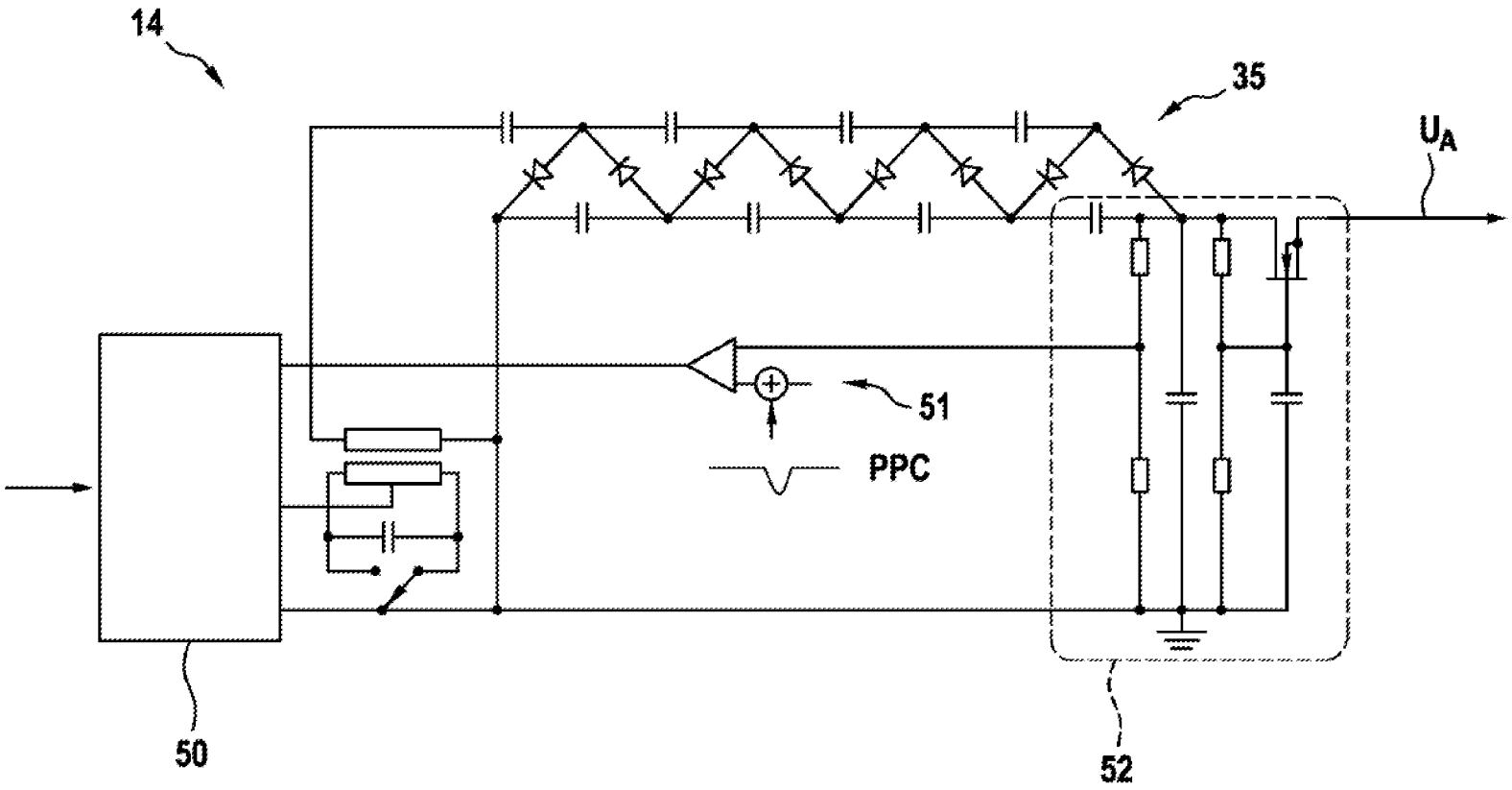
FIG. 12 shows a switch for pulsed operation of the anode of the X-ray apparatus according to FIG. 1.

The anode power supply unit 14 according to FIG. 12, which is part of the arrangement according to FIG. 1, supplies voltage pulses at a constant level, so that the X-ray apparatus 1 is operated in the single energy mode. The X-ray tube 2 comprises a plurality of X-ray sources. The cathodes provided for generating the electron beams EB in this exemplary embodiment have carbon nanotubes as emitters. An alternative, the apparatus according to FIG. 12 may be used for operating an X-ray tube with a single emitter.

Prepulse compensation PPC of the control device 3 is provided for avoiding a short-term voltage decrease, a so-called drop, at the beginning of a voltage pulse, and as is indicated in FIG. 12, processes a trigger signal 51. The prepulse compensation PPC means that with the aid of the trigger signal 51, the voltage at the beginning of the pulse to be generated is elevated somewhat relative to the desired voltage level to compensate for parasitic effects, especially due to capacitances. Here, the trigger signal 51 already precedes the beginning of the voltage pulse to be generated by a few microseconds. As a result, a voltage pulse of the anode voltage $U_A$ is produced, which to a high probability represents a rectangular pulse. The anode voltage $U_A$ falls in the range from ±10 kV to ±130 kV.

In contrast to FIGS. 1 to 12, FIGS. 13 and 14 relate to X-ray devices 1 that are operated with dispenser cathodes. The X-ray device 1 equipped with the anode energy supply unit 14 according to FIG. 13 has two grids within the X-ray tube 2 to which electrical voltage is applied via grid connections GA1, GA2.

In addition, a heating element is present, which is to be connected via a heating connection HA.

Figure 13:
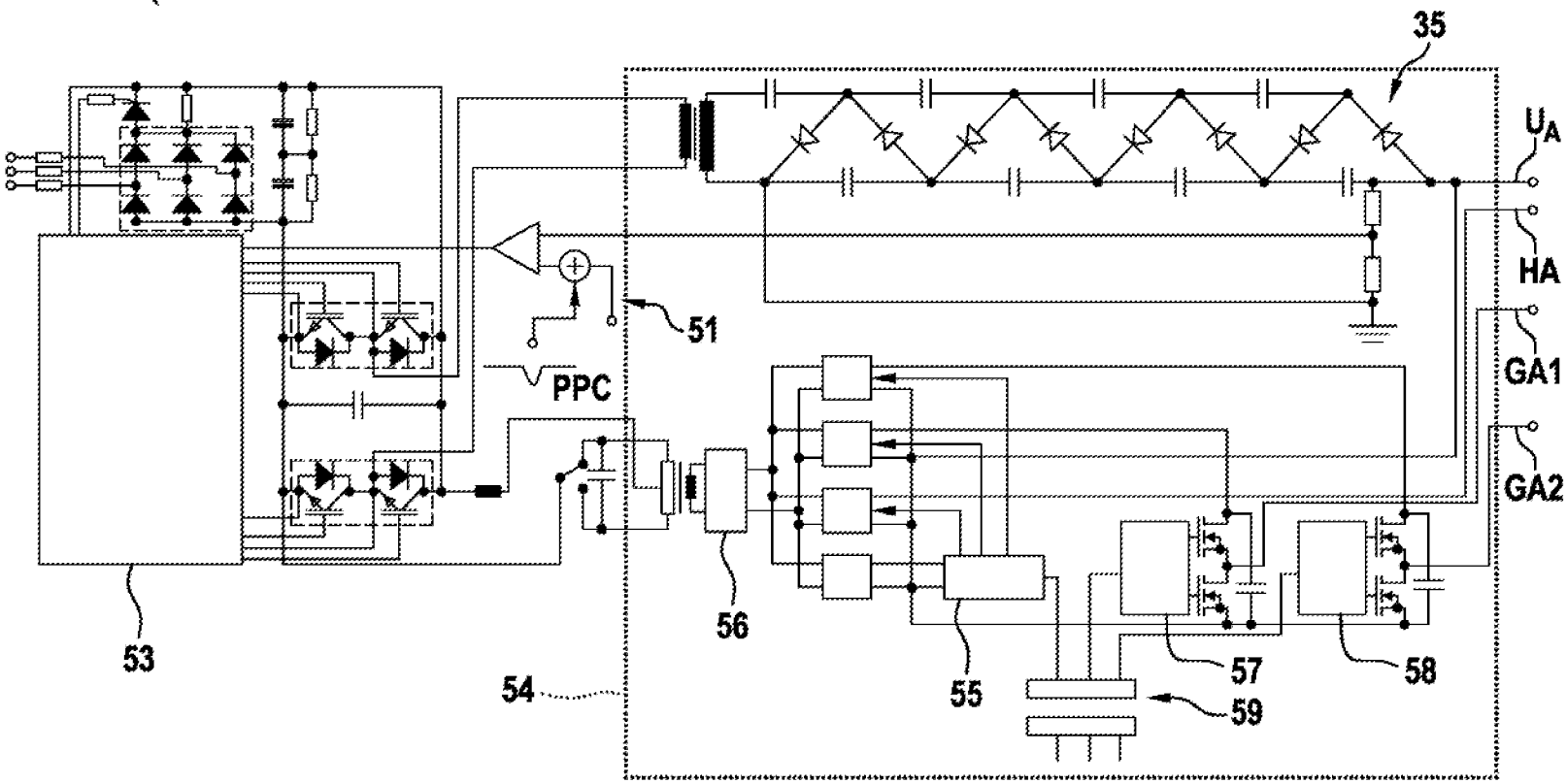
FIG. 13 provides a power supply circuit of an anode of an additional X-ray apparatus.

The anode power supply unit 14 according to FIG. 13 is controlled by pulse width modulation (PWM). Within the anode power supply unit 14, 53 indicates a phase-shift PWM controller, 54 an oil tank, 55 a controller, 56 an alternating current-direct current converter, 57 and 58 respectively a gate driver and 59 an optocoupler.

Figure 14:
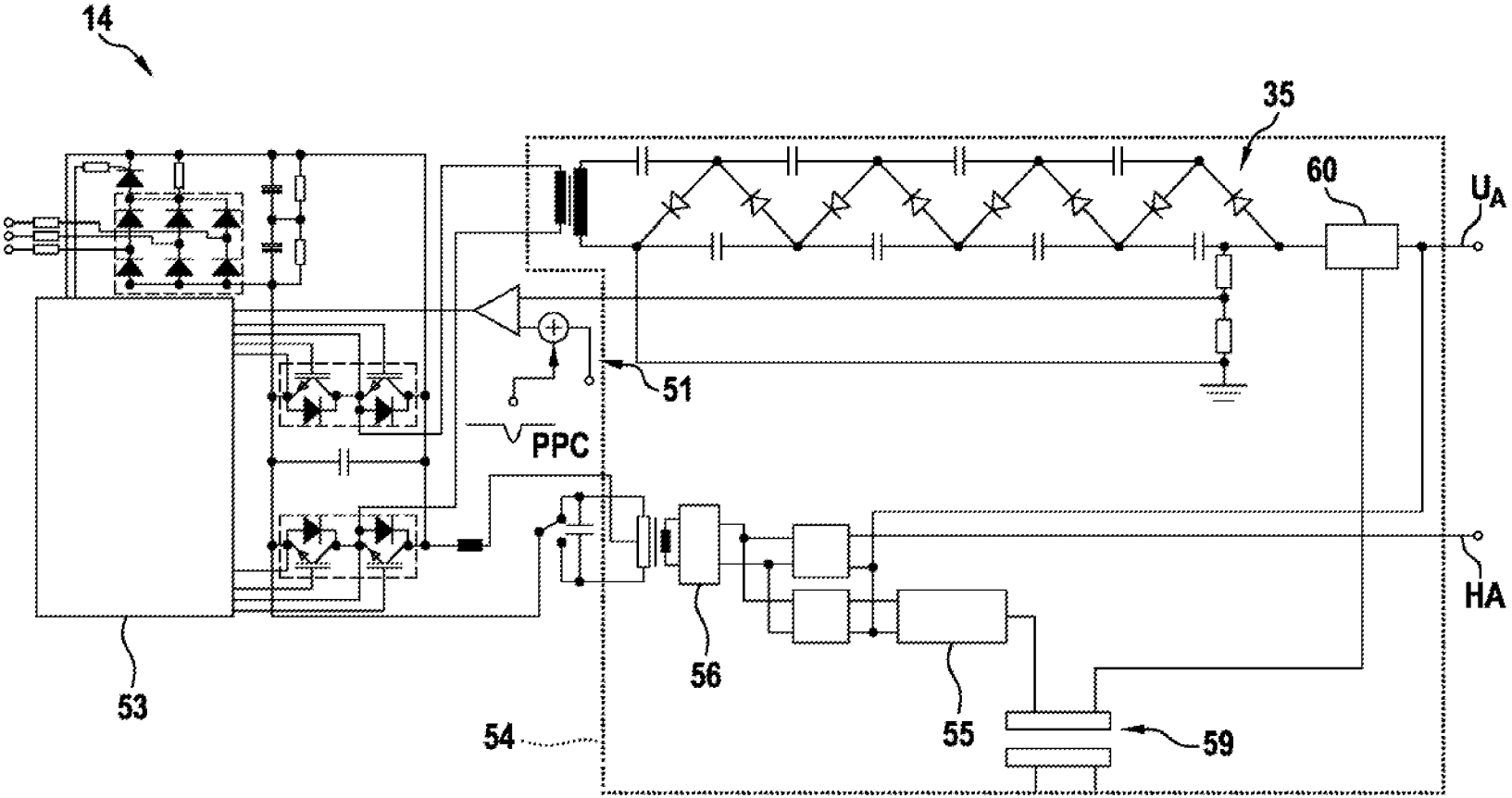
FIG. 14 depicts an alternative embodiment for controlling an anode of an X-ray apparatus.

The embodiment according to FIG. 14 differs from the exemplary embodiment according to FIG. 13 through the absence of the grid connections GA1, GA2. A high-voltage switch is designated as 60 in FIG. 14.

In contrast to the arrangements according to FIGS. 13 and 14, which are intended for producing anode voltage $U_A$ with a constant level, the pulses produced using the device according to FIG. 1, which describes the anode voltage $U_A$, from pulse to pulse lie either at a uniform level or at different voltage levels.

Figure 15:
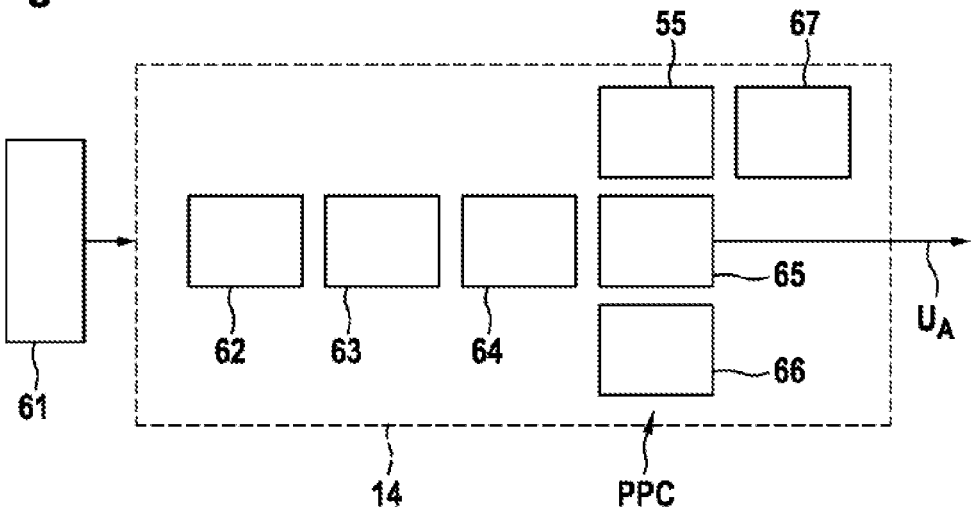
FIG. 15 provides the theoretical design of a circuit for pulsed operation of an anode of an x-ray apparatus with variable voltage levels.

In the last-named case, the circuit shown for use in FIG. 15, by which pulsed anode voltage $U_A$ is generated with suddenly changing levels, is suitable for use in X-ray device 1. Here, 61 designates a line voltage connection, 62 an inverter, 63 a transformer, 64 a direct current-alternating current converter, and 65 a Marx generator. A measuring device 67 is provided for measuring current and voltage. Components with which the prepulse compensation PPC is realized are parts of a circuit 66. During each individually generated voltage pulse, the current control remains in effect, as sketched in FIG. 1.

The current control can be designed in the form of various control loops CR1, CR2, CR3, CR4. In all cases a certain anode current setpoint $I_{A\text{-}S}$ is preset. This current setpoint $I_{A\text{-}S}$ is compared with measured values. In the simplest case this is merely a matter of the actual anode current $I_{A\text{-}actual}$. The corresponding control loop is designated by CR2. If the grid current designated by $I_G$ is also included in the control, i.e., the current flowing out through the extraction grid 10, the control loop CR4 is present. The focusing electrodes 11, 12 also play a role in the control loops CR3 and CR1. In the case of control loop CR3, the focusing electrodes 11, 12 are operated passively, i.e., at the same potential as the housing of the X-ray tube 2. On the other hand, in the case of control loop CR1, active focusing is used. In this case the focusing electrodes 11, 12 can be operated with constant or pulsed voltages on the order of −10 KV to +10 KV. The current flowing through the focusing electrodes 11, 12 is designated by $I_{F1}$ and $I_{F2}$ respectively. The control loop CR1 is the most complex form of current regulation overall.

Figure 16:
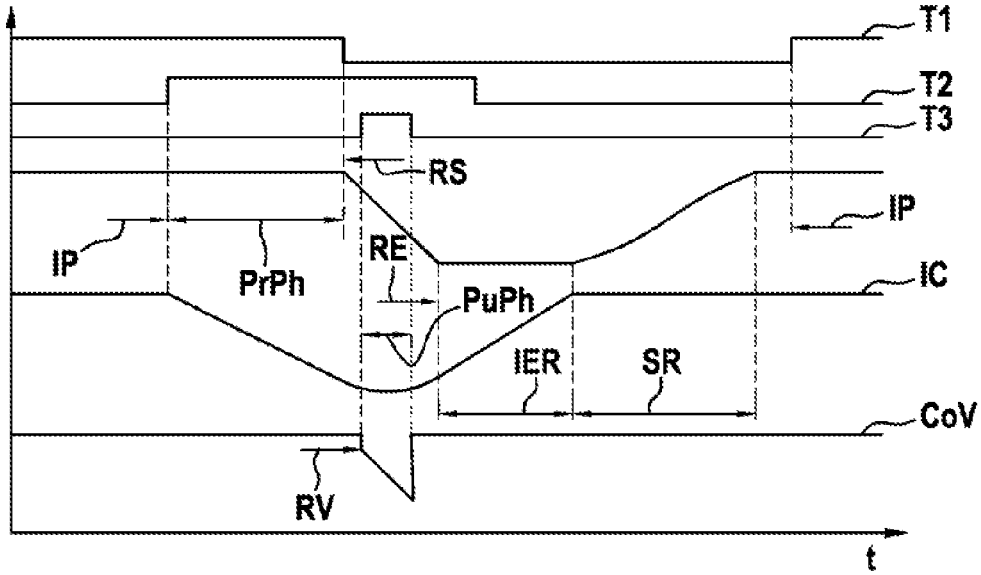
FIG. 16 is a diagram of properties of a component of the circuit according to FIG. 15.

With the diagram according to FIG. 16, reference is made to FIG. 15. Here, details of the prepulse compensation PPC are shown. In the diagram, CoV designates the compensator voltage, which is generated by the circuit 66, the compensation circuit. The compensation process is influenced by various trigger signals T1, T2, T3. Here, the trigger signal T3 influences the beginning of the pulse, which is described by the compensator voltage CoV and a shape increasing according to the absolute magnitude, in other words, it has the shape of an individual sawtooth. The duration of this pulse is designated in FIG. 16 as the pulse-phase duration PuPh. To supply the pulse in the desired amount at the right time, an internal voltage within the circuit 66, the course of which is shown in FIG. 16 directly below the three trigger signals T1, T2, T3, ramps down immediately before the beginning of the sawtooth pulse of the compensator voltage CoV. The start of this ramp is designated as the ramp start RS in FIG. 16. The ramp start RS is chronologically advanced relative to the start of the sawtooth pulse ahead of the compensator voltage CoV by a ramp shift RV. The end of the ramp of the internal voltage is designated by RE. Then a constant voltage level is maintained until, within a voltage decline phase SR, the internal voltage is returned to the initial value, namely 0 volt.

The trigger signals T2 and T1 mark the end and the beginning of idling states IP. After the end of the idling phase IP shown first chronologically in FIG. 16, a preload phase PrPh begins. During this preload phase PrPh, without the compensator voltage CoV showing a deflection, an internal current in the circuit 66 drops. Since the initial current is 0 amperes, an absolute magnitude increase in the current exists here. The current is designated as the inductor current IC. The absolute minimum, i.e., the absolute magnitude maximum, of the inductor current IC, is present in the sawtooth pulse of the compensator voltage CoV. Then the current rises again within an inductor energy recovery phase IER. At the beginning of the voltage decline phase SR, the inductor current IC has again assumed the value of 0 ampere.

Figure 17:
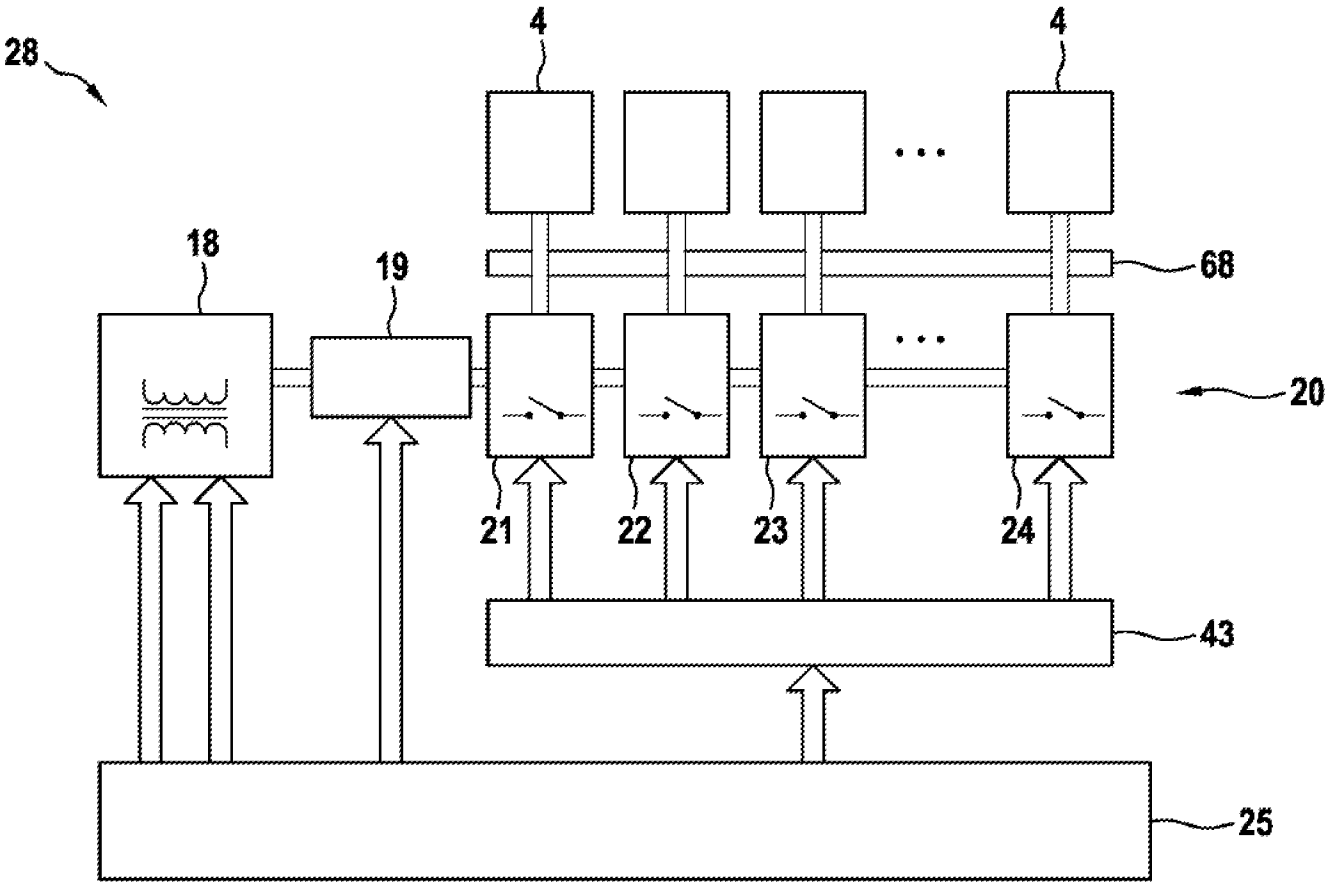
FIG. 17 is a block diagram of the structure of a cathode control device of the X-ray apparatus according to FIG. 1.

The plurality of individual cathodes 4, which are located within the X-ray tube 2 and are controlled by the central anode current control unit 19, are shown schematically in FIG. 17. The number of cathodes 4 in this case is not subject to any theoretical imitations. If necessary, the cathodes 4 can be discharged rapidly through a discharge circuit 68, which is connected to the cathode circuit array 20. The discharge circuit 68 comprises a chain of resistors, the first end of which is grounded, while the second end of the chain of resistances is connected via a switch to the cathode 4 to be discharged during the discharging process.

Although the structures, devices, methods, and systems have been described in accordance with particular embodiments, one of ordinary skill in the art will readily recognize that many variations to the particular embodiments are possible, and any variations should therefore be considered to be within the spirit and scope disclosed herein. Accordingly, many modifications may be made by one of ordinary skill in the art without departing from the spirit and scope of the appended claims.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description. These additional embodiments are determined by replacing the dependency of a given dependent claim with the phrase "any of the claims beginning with claim [x] and ending with the claim that immediately precedes this one," where the bracketed term "[x]" is replaced with the number of the most recently recited independent claim. For example, for the first claim set that begins with independent claim 1, claim 3 can depend from either of claims 1 and 2, with these separate dependencies yielding two distinct embodiments; claim 4 can depend from any one of claim 1, 2, or 3, with these separate dependencies yielding three distinct embodiments;

claim 6 can depend from any one of claims 1, 2, 3, or 4, with these separate dependencies yielding four distinct embodiments; and so on.

Recitation in the claims of the term "first" with respect to a feature or element does not necessarily imply the existence of a second or additional such feature or element. Elements specifically recited in means-plus-function format, if any, are intended to be construed to cover the corresponding structure, material, or acts described herein and equivalents thereof in accordance with 35 U.S.C. § 112(f). Embodiments of the invention in which an exclusive property or privilege is claimed are defined as follows.

The invention claimed is:

1. A control device for an X-ray tube, the X-ray tube comprising an anode configured as an X-ray emitter and a plurality of cathodes for generating electron beams directed at the anode; the control device comprising:

a housing configured as a shield;

an anode current regulating unit connected to a cathode power supply unit;

a plurality of cathode voltage switches, and a plurality of cathodes, each of the plurality of cathode voltage switches being connectable to a cathode;

a programmable assembly, in which control of the cathodes is determined, wherein the anode current regulating unit, the cathode power supply unit, the cathode voltage switches and the programmable assembly are arranged in the housing;

a plurality of focusing electrodes associated with individual cathodes of the plurality of cathodes, and an extraction grid provided between the cathodes and the focusing electrodes, wherein the extraction grid is grounded independently of the focusing electrodes;

wherein the programmable assembly comprises a field programmable gate arrangement (FPGA), a microcontroller, and a multiplexer, the FPGA being programmable so that a pulse sequence is triggered in real time, wherein timing of the pulse sequence occurs solely through the FPGA, and wherein the multiplexer is configured to switch between a desired voltage level for a boost and for an actual pulse of the pulse sequence.

2. The control device of claim 1, wherein the cathode voltage switches are configured as a high-voltage switch bank with a plurality of MOSFETs.

3. The control device of claim 2, wherein said device comprises a discharge circuit configured for discharging capacitances formed by the cathodes including feed lines, which is connected to the cathode voltage switches.

4. The control device of claim 1, wherein the programmable assembly is configured for storing operating parameters measured during operation of the X-ray tube.

5. The control device of claim 1, wherein the cathodes comprise field emission cathodes.

6. The control device of claim 5, wherein the cathodes comprise nanosticks, and wherein the nanosticks are electron emitters and are at least one of carbon nanotubes, nanotubes made of lanthanum hexaboride, and nanotubes made of cerium hexaboride.

7. The control device of claim 1, wherein the cathodes comprise dispenser cathodes.

8. The control device of claim 1, further comprising an anode voltage supply unit.

9. The control device of claim 8, wherein the anode voltage supply unit is configured for pulsed operation of the anode.

10. The control device of claim 8, wherein the anode voltage supply unit comprises a Marx generator.

* * * * *